US006047399A

United States Patent [19]

Bachner, Jr.

[11] Patent Number: 6,047,399

[45] Date of Patent: Apr. 11, 2000

[54] MULTI-COMPONENT PROTECTIVE GARMENT WITH COMPOSITE STRIKE FACE AND WOVEN BASE

[75] Inventor: Thomas E. Bachner, Jr., Eastport, Mich.

[73] Assignee: Second Chance Body Armor, Inc., Central Lake, Mich.

[21] Appl. No.: 08/957,700

[22] Filed: Oct. 24, 1997

[51] Int. Cl.[7] ..... F41H 1/02

[52] U.S. Cl. ..... 2/2.5

[58] Field of Search ..... 2/2.5; 428/911; 89/36.05, 36.01, 36.02

[56] References Cited

U.S. PATENT DOCUMENTS

| | | | |
|---|---|---|---|
| 5,479,659 | 1/1996 | Bachner, Jr. | 2/2.5 |
| 5,619,748 | 4/1997 | Nelson et al. | 2/2.5 |
| 5,724,670 | 3/1998 | Price | 2/2.5 |

FOREIGN PATENT DOCUMENTS

| | | | |
|---|---|---|---|
| 8403529 | 6/1986 | Netherlands | 2/2.5 |

*Primary Examiner*—Michael A. Neas

*Attorney, Agent, or Firm*—Wildman, Harrold, Allen & Dixon; Thomas J. Ring

[57] ABSTRACT

A ballistic resistant protective garment of multi-component construction for covering and protecting vital portions of the body of the wearer. The garment having layers of composite body armor material which are positioned generally at the strike face portion of the garment. Each layer of the composite body armor material is formed of resin plies having high tensile strength fibers disposed therein. The high tensile strength fibers of one ply are placed in a transverse direction to the high tensile strength fibers of an adjacent ply and a laminate film covers the sub-layer plies enclosing them and sandwiching them together to form a single layer of the composite material. The combined multicomponent construction of the overlying layers formed of laminated plies of aramid and resin with the woven flexible panels of high tensile strength fiber sheets together create a multi-component thin and lightweight ballistic resistant body armor pad. The pad is of such thin and lightweight properties that it meets NIJ Standard 0101.03 standard specifications for Threat Level IIA with an areal density of 0.69 lbs./ft$^2$ with a thinness of 0.17 inches; for Threat Level II, an areal density of 0.84 lbs./ft$^2$ with a thinness of 0.20 inches; and for Threat Level IIIA, an areal density of 0.99lbs./ft$^2$ with a thinness of 0.23 inches.

65 Claims, 4 Drawing Sheets

MULTI-COMPONENT PROTECTIVE GARMENT WITH COMPOSITE STRIKE FACE AND WOVEN BASE

FIELD OF THE INVENTION

The present invention relates to protective garments for resisting ballistic forces and more particularly to protective ballistic body armor garments having multi-components.

BACKGROUND OF THE INVENTION

In the evolution of protective garments, there has been an ever pressing desire to develop stronger, lighter, thinner, more breathable and thereby more wearable garments. Such garments are intended to resist certain potentially lethal forces such as those from gun shots. Typically, these garments are designed to protect the wearer from ballistic forces by preventing penetration through the garment from a projectile bullet.

Attempts at developing thinner, lighter, flexible and more breathable protective body armor have been made in order to create garments that are more wearable to the user. The more light and thin the protective ballistic resistant garment is, the more likely the user (such as a law enforcement officer) will actually wear the garment, especially during the long hours of a working shift.

It is also desirable to have the protective body armor garment cover as much of the wearer's torso as possible while also maintaining wearability. The thinner and lighter the protective article, the more coverage can be offered. Concealability of the anti-ballistic body armor may also be improved if it is constructed to be thin and non-bulky. These attempts at developing thin and lightweight ballistic resistant body armor articles have also been made to try to allow increased freedom of movement and mobility so that the law enforcement officer wearing the article is not hampered from doing his or her job.

These attempts at reducing weight while improving the thinness of the article have previously been made by the utilization of multiple layers of woven sheets of ballistic resistant material. High tensile strength aramid fibers such as Kevlar® produced by E.I. DuPont de Nemours & Company of Wilmington, Del., have often been employed in forming the woven ballistic resistant fabric. However, to increase the level of protection against higher caliber pistols and firearms more layers of ballistic resistant fabric are unfortunately required thereby increasing the overall weight and thickness of the garment while reducing its flexibility.

Various voluntary governmental ballistic standards have been established to certify certain ballistic resistant garments. The tests determine the ability of the garment to resist penetration from various ballistic rounds shot from various types of weapons. In particular, the National Institute of Justice (NIJ) Standard 0101.03 certification tests is a frequently used ballistics test for certifying certain body armor products. The NIJ Standard 0101.03 certification tests are grouped into different threat levels, with each threat level corresponding to ballistic projectile penetration stopping capabilities of various ballistic rounds fired from designated weapons. For generally concealable type ballistic resistant body armor NIJ Standard certification tests are often performed for NIJ threat levels IIA, II and IIIA. NIJ threat level IIIA is a higher standard level than NIJ threat level II and which in turn is a higher standard level than NIJ threat level IIA. There is therefore a need to provide the thinnest and most lightweight protective body armor garments as possible to increase their wearability, while also meeting test specifications of NIJ Standard 0101.03 Threat Level IIA, II and IIIA certification tests.

SUMMARY OF THE INVENTION

The foregoing needs noted above are met in accordance with the present invention by a protective garment of multi-component construction having a plurality of layers of composite body armor material of resin and fibers arranged in overlying plies positioned at the strike face region of the garment and a plurality of flexible woven sheets constructed of high tensile strength fibers positioned in underlying relationship to the composite body armor layers.

Another object of this invention is provide a ballistic resistant protective garment having thin and lightweight properties that meets NIJ Certification of NIJ Standard 0101.03 standard specifications for Threat Level IIA with an areal density of 0.69 lbs./ft$^2$ with a thickness no greater than 0.17 inches; for Threat Level II, with an areal density of 0.84 lbs./ft$^2$ with a thickness no greater than 0.20 inches; and for Threat Level IIIA, an areal density of 0.99 lbs./ft$^2$ with a thickness no greater than 0.23 inches.

BRIEF DESCRIPTION OF THE DRAWINGS

The foregoing objects and advantageous features of the invention will be explained in greater detail and others will be made apparent from the detailed description of the preferred embodiments of the present invention which is given with reference to the several figures of the drawing, in which.

DETAILED DESCRIPTION

Figure 1:
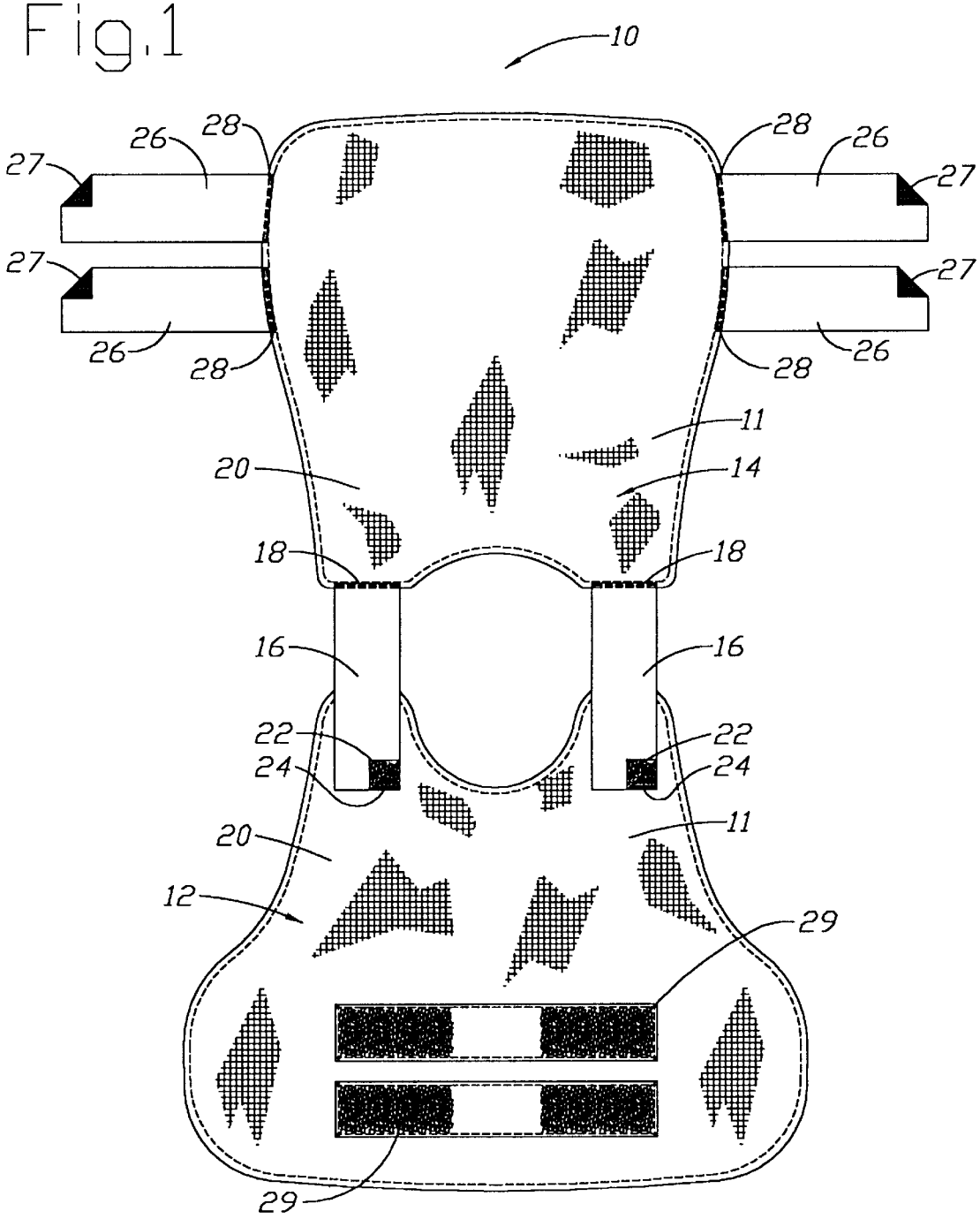
FIG. 1 is a plan view of the protective garment encased within a carrier.

Referring now to FIG. 1, ballistic resistant protective garment 10 for covering vital portions proximate to a torso region of a body is shown. The garment has a front strike face portion 11 for positioning away from the body of the wearer which initially receives the impact of a ballistic projectile and an opposing inner backing portion to be positioned adjacent the body of the wearer. The protective body armor garment 10 has a front garment section 12 for generally overlying the front region of the wearer and back garment section 14 for generally positioning proximate a back region of the wearer. The front section 12 and back section 14 are adjustably connected by shoulder straps 16. The ends 18 of shoulder straps 16 are preferably secured (by stitching or other suitable means) to an outer cloth carrier sleeve 20 of the back section 14 of the garment. The carrier sleeve 20 is preferably constructed of a woven cloth fabric material such as Nylon, Polyester, woven or rip stop taffetta, mesh net, tricot net or any other suitable cloth material. The carrier sleeve 20 encases body armor pads in both the front section 12 and back section 14. As will be discussed in greater detail with reference to FIGS. 2–5C, the body armor pad 30 encased by the outer carrier sleeve 20 has a plurality of layers of composite body armor material 55 and a plurality of flexible woven sheets 58, 60 of high tensile strength fiber.

As seen in FIG. 1, the opposing ends 22 of shoulder straps 16 have releasable hook and loop fasteners or Velcro® which engage corresponding mating fastener members 24 placed at a shoulder region of the outer cover 20 of front garment section 12. The shoulder straps 16 are adjustable to move the front 12 and back 14 sections to a desired position over the torso region of the body of the wearer.

In use, the front garment section 12 and back garment section 14 may also be suitably secured at their side regions by side straps 26. The side straps 26 are secured at one end 28 by stitching or other satiable means to the outer carrier 20 of back section 14. The opposing ends 27 of side straps 26 preferably have Velcro® type hook and loop fasteners which are releasably securable to mating engagement member 29 engaging the outer cloth carrier at the front section 12 of the garment. The side straps 26 are pulled firmly about the torso of the wearer and the free ends 27 are overlaid and engage mating hook and loop fastener member 29 to snugly fit the garment about the body of the wearer.

Figure 2:
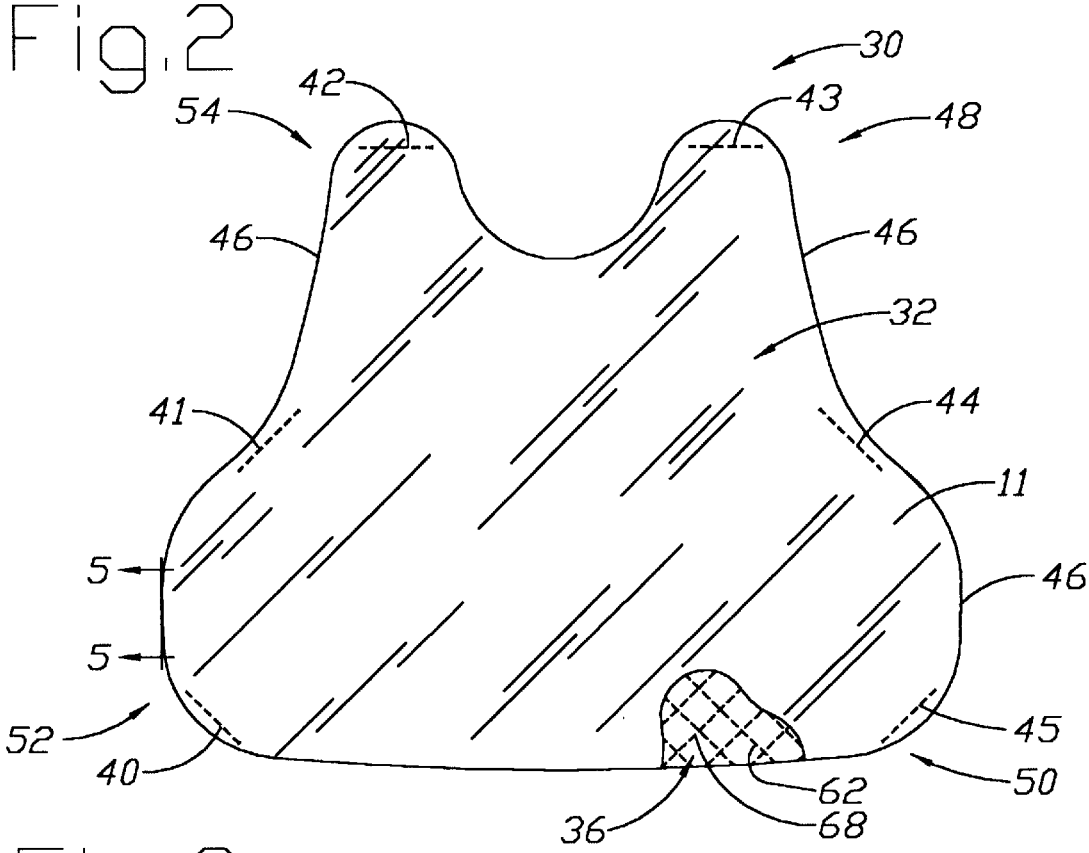
FIG. 2 is a partial broken away plan view of the front of multi-component body armor pad of the protective garment shown in FIG. 1 with the composite structure panel positioned over a woven soft body armor panel.

Referring now to FIG. 2, a multi-component body armor pad 30 of the front garment section is seen having a multi-component construction. Composite panel 32 formed of a plurality of layers 55, FIGS. 5A–5C, of composite body armor material, which will be discussed in more detail below, overlies a soft body armor panel 34, FIG. 3, preferably comprising a first sub-panel 36 and a second sub-panel 38 each having a plurality of soft flexible woven sheets 58, 60, FIGS. 5A–5C, constructed of high tensile strength fiber. The multi-component body armor pad 30, FIG. 2, is formed of the composite panel 32 positioned at a strike face 11 portion of the garment and of the underlying woven body armor panel 34 positioned generally at a base portion of the garment proximate the body side which comprises a multiplicity of layered woven sheets of aramid fiber. As seen in FIG. 2, a number of bar tacs 40–45 are engaged entirely through both the composite panel 32 and the woven body armor panel 34 in order to secure all the layers 55, FIGS. 5A–5C, of the composite body armor material of the composite panel 32 to the woven sheets 58, 60 of high tensile strength material of the woven body armor panel thereby holding all of them together.

It may be desirable to selectively employ a pad cover (not shown) for snugly enclosing and encasing the multi-component body armor pad 30 formed of composite panel 32 and woven soft body armor panel 34. Preferably, a pad cover selectively employed will have the approximate shape of the multi-component pad to provide a close fit with the pad. A pad cover is a flexible sleeve preferably constructed of vapor permeable and water proof material such as Gore-Text®, or Windstopper® of W. L. Gore Associates of Newark, Del.

Figure 4:
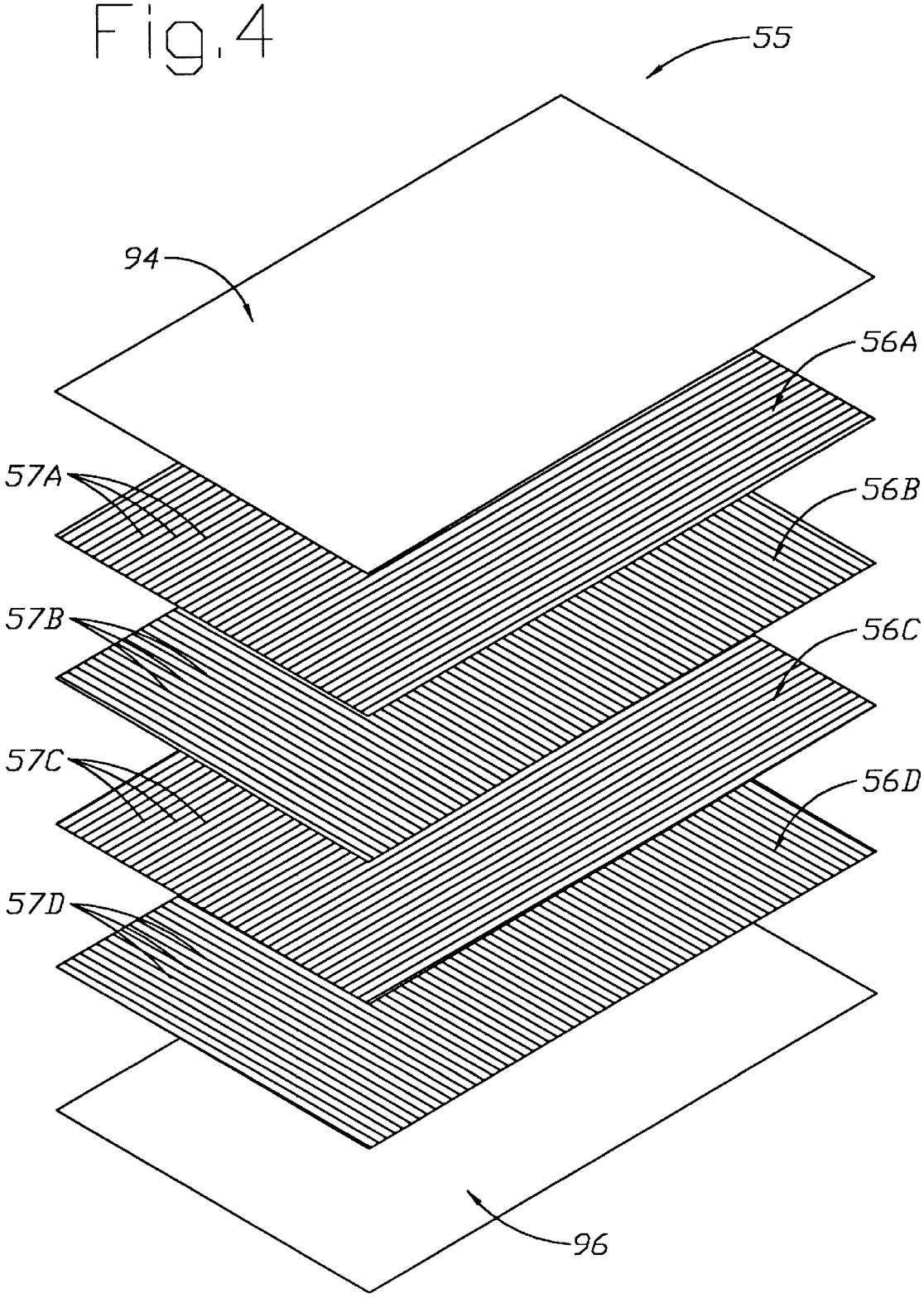
FIG. 4 is an exploded view of the sub-layer plies which compose the individual layers of the composite structure panel, seen in FIG. 2, which is illustrative of the orientation of the fibers disposed within a particular ply.

As discussed in greater detail in FIG. 4, the composite panel 32 positioned at the outer front or strike face region 11 of the multi-component pad 30 is formed of a multiplicity of individual layers of composite body armor material which overlie one another to form the composite panel. Each individual layer 55, FIG. 4, is formed of a number of sub-layer resin plies, 56A–56D, in which each ply has a unidirectional high tensile strength aramid fiber impregnated with a resin matrix. The aramid fibers 57A–57D extending and disposed within the sub-layer resin plies 56A–56D are preferably positioned in a transverse relationship to the adjacent sub-layer plies in a single layer 55 of the composite body armor material. A laminate covering 94, 96 encloses and sandwiches together the sub-layer resin plies 56A–56D to form a single layer 55 of composite body armor material.

Figure 3:
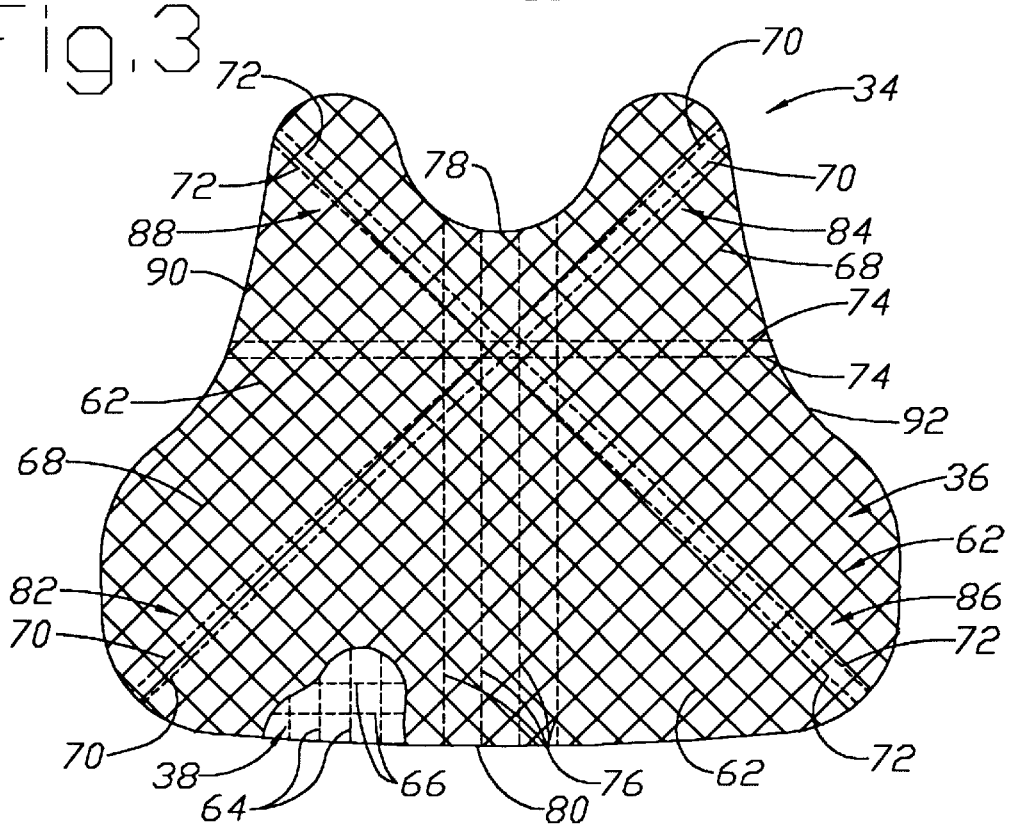
FIG. 3 is a partial broken away plan view of the woven soft body armor protective panel of the front garment section of the protective garment shown in FIG. 2.
Figure 5A:
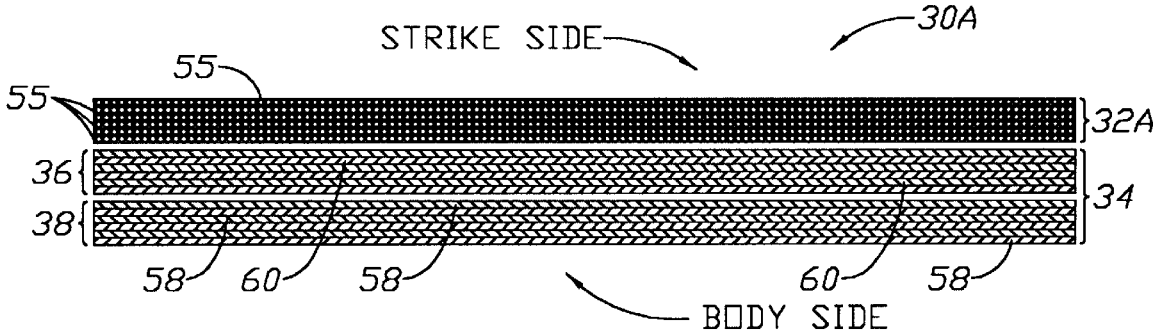
FIG. 5A is an enlarged end view which is illustrative of the multi-component body armor pad without stitching, as seen along line 5—5 in FIG. 2.
Figure 5B:
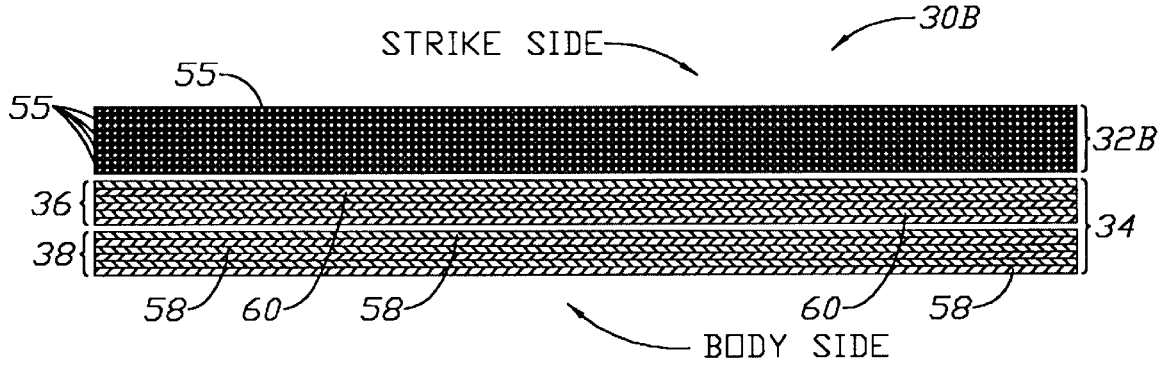
FIG. 5B is an enlarged end view which is illustrative of the multi-component body armor pad without stitching of another embodiment, as seen along line 5—5 in FIG. 2.
Figure 5C:
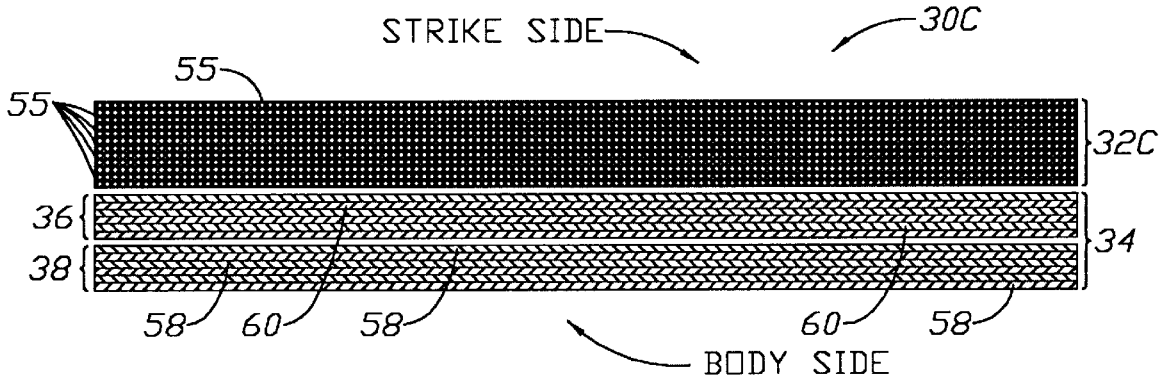
FIG. 5C is an enlarged end view which is illustrative of the multi-component body armor pad without stitching of another embodiment as seen along line 5—5 in FIG. 2.

As discussed in greater with reference to FIG. 3, the woven body armor panel 34 is formed of a pair of sub panels 36, 38, with each sub-panel having preferably six layered sheets 58, 60, FIGS. 5A–5C, of woven high tensile strength aramid fibers positioned to overlie one another. Preferably the layered sheets 58, 60 in panels 36, 38 are constructed of Twaron® T-2000 microfilament fibers sold by AKZO NOBEL, Inc. and are woven into the sheets having an imbalanced 24×22 weave. The first and second woven soft body armor sub-panels 36, 38 of the present invention preferably employ Araflex® IV and Araflex® V protective body armor fabric, the fourth and fifth generation of ballistic resistant material of Second Chance Body Armor, Inc. of Central Lake, Mich.

Referring again to FIG. 2, the plurality of bar tac securement members 40–45 penetrate through each of the layers 55, FIGS. 5A–5C, of composite body armor material and each of the underlying woven sheets 58, 60 to secure the composite panel 32 and soft body armor panel 34 together forming the multi-component pad 30. The bar tacs 40–45 are each approximately one inch long and are positioned proximate to the edge 46 of the layers of composite body armor material and the flexible woven sheets. As seen in FIG. 2, bar tac 43 is placed in the upper right corner 48, bar tac 40 is placed in the lower right corner 50, bar tac 42 is placed in the upper left corner 54 and bar tac 40 is placed in the lower left corner 52 of the layers 55 of composite panel 30. Bar tacs 41 and 44 are placed at each outboard corner of the pad 30. Preferably, bar tacs 40–45 are each placed approximately one inch from the edge 46 of the multi-component pad 30. As seen in FIG. 2, bar tac 44 is positioned between bar tac 43 at the upper right corner 48 and bar tac 45 at the lower right corner 50 of the layers of composite body armor material of the composite panel 32. Bar tac 41 is similarly positioned between bar tac 42 at the upper left corner 54 and bar tac 40 at the lower left corner 52 of the layered composite material in composite panel 32.

In accordance with the present invention, the multi-component construction of the body armor pad 30 provides for the thinnest and most light weight known soft body armor to meet National Institute of Justice (NIJ) Standard 0101.03 certification tests for Threat Levels IIA, II and IIIA. As will be discussed in greater detail with reference to FIGS. 5A–5C the protective garment of the present invention has an embodiment of a combined nonwoven composite and woven sheet body armor construction for each of Threat Level IIA, II and IIIA of NIJ Standard 0101.03 certification tests. The embodiment of FIG. 5A illustrates a multi-component body armor pad 30A which has a ballistic resistance that prevents projectile penetration according to NIJ Standard 0101.03 for Threat Level IIA. The body armor pad 30A of this embodiment is of extreme light weight and thinness in that it preferably employs only six layers of the composite body armor material as the strike side and only twelve of the underlying woven sheets of aramid fiber (six sheets in sub-panel 36 and six sheets in sub-panel 38) at the base of the garment for a combined total areal weight of only 0.69 pounds per square foot (lbs./ft$^2$) with a total thinness of 0.17 inches.

The thin and lightweight body armor pad 30B, FIG. 5B, meeting the ballistic specification requirements under NIJ Standard 0101.03 for Threat Level II employs only nine layers of the overlying composite body armor material 55 and only twelve flexible woven sheets 58, 60 of aramid fabric. The combined areal density weight for the body armor pad 30B meeting Threat Level II requirements is only 0.84 lbs/ft$^2$ with a total thinness of only 0.20 inches.

The multicomponent body armor panel 30C, FIG. 5C, preferably employs twelve layers of composite body armor material 55 and twelve underlying flexible woven sheets 58, 60 of aramid fabric to form pad 30C having a ballistic resistance that prevents projectile penetration according to NIJ Standard 0101.03 for Threat Level III. The areal density for the pad 30C, FIG. 5C, is 0.99 lbs/ft$^2$ with a total thinness of only 0.23 inches. The present invention provides extremely low weight, thin and flexible body armor for wearability and concealability while still preventing ballistic penetration.

Referring now to FIG. 3, front garment section 12 is shown without an outer carrier and with the composite panel of layered body armor material removed to illustrate the woven body armor panel 34 formed of distinct sub-panels 36, 38. Woven body armor panel 34 has at least two panels 36, 38 which are adjacent and overlie one another. Each of panels 36, 38 is composed of a plurality of woven ballistic resistant material 58, 60, FIGS. 5A–5C. As seen in FIGS. 5A–5C, the underlying protective panel 38 is formed of plurality of flexible woven sheets 58 each constructed of high tensile strength ballistic resistant material. The embodiments in FIGS. 5A–5C show first sub-panel 36, having six woven sheets 60 of ballistic resistant material overlying one another. Likewise, the overlying second sub-panel 38 also preferably has six layered sheets 58 of ballistic resistant material. Each panel 36, 38 preferably has the same number of layers 58, 60 of ballistic resistant material with each sub-panel having substantially the same thickness. In accordance with the present invention, panel 36 is formed of at least two layered sheets of woven ballistic resistant material 60 and panel 38 is formed of at least two layered sheets of woven ballistic resistant material 58. Each of the sheets 58, 60 of woven high tensile strength fiber are co-extensive to one another each having substantially the same shape.

The high tensile strength material preferably employed in the woven sheets 58, 60 FIGS. 5A–5C, of panels 36, 38, FIG. 3 is Twaron® T-2000 microfilament having a denier of 860 produced by AKZO Nobel, Inc. The plurality of flexible woven sheets 58, 60 of the present invention preferably have an imbalanced weave of 24 by 22 warp to fill ratio with the Twaron® T-2000 fiber having filament crossovers of approximately 528,000,000 per square inch and having a weight of approximately 4.9 ounces per square yard. Alternative aramid fiber such as Kevlar® 129 produced by DuPont Company of Wilmington, Del. may be suitably employed. The Kevlar® 129 aramid fiber has a denier of 840 and filament cross-overs of approximately 166,000,000 per square inch. Likewise, the ballistic resistant sheets 58, 60 of woven fabric of Kevlar® 129 preferably utilize an imbalance weave of 24 by 22 warp to fill ratio and has an areal weight of approximately 4.9 ounces per square yard.

The woven material employed in sheets 58, 60 is particularly effective and efficient is resisting ballistic penetration while still maintaining optimum wearability characteristics. Thus, the present invention achieves efficient penetration resistance with less weight and bulk of ballistic resistant material. Araflex® IV and Araflex V protective body armor fabric, the fourth and fifth generations of ballistic resistant material of Second Chance Body Armor, Inc. is preferably employed in the soft body armor layers of the present invention. For further details on the characteristics of woven layers of ballistic resistant materials which may be suitably employed, reference may be made to U.S. Pat. No. 5,479,659 entitled "Lightweight Ballistic Resistant Garments And Method To Produce Same" issued Jan. 2, 1996, to Bachner, Jr. which is incorporated herein by reference.

As seen in FIG. 3, a plurality of woven sheet securement stitches 62 are disposed into first panel 36 which only connect the ballistic layers 60, FIG. 5A–5C, of the first panel 36. For purposes of the present description, of this feature, the structural description will equally apply to the panels of front garment section 12 as well as to the back garment section 14, FIG. 1. The plurality of stitches 62 across top sub-panel 36 are positioned in a row in a first direction. Another plurality of stitches 64, 66 which are disposed into the second underlying panel 38 only connecting, likewise, just the ballistic resistant layers 58, FIGS. 5A–5C, within second panel 38. These plurality of woven sheet securement stitches are positioned in at least two rows 64, 66, in which the plurality of stitching rows 64, 66 are in second (generally vertical) and third (generally horizontal) directions respectively, as seen in FIG. 3. Second and third directions of stitching 64 and 66 are transverse to one another and in addition, row 62 of stitching having first direction across first panel 36 is transverse to the two rows 64, 66 positioned in the aforementioned second and third directions across the second or underlying sub-panel 38, as also seen in FIG. 3.

The stitches disposed in first sub-panel 36 have, as seen in FIG. 3, plurality of stitching rows 62 which are spaced apart and are substantially parallel to one another in a first direction. The top sub-panel 36 also includes a plurality of other crossing rows of woven sheet securement stitches 68 spaced apart from one another which are substantially parallel to one another whereby the rows 62 of stitches in the first direction and the plurality of other rows 68 securing the sheets 60 of ballistic resistant material are transverse to one another and in this embodiment substantially perpendicular to one another. Moreover, the plurality of rows of stitches 62, 68 of first sub-panel 36 each extend substantially across first panel 36, as seen in FIG. 3. The rows of woven sheet securement stitches 62, 68 of first overlying panel 36 form a pattern of quilt stitches in the first panel 36.

The second underlying panel 38, as seen in FIGS. 3, has the plurality of rows of sheet securement stitches 64 being spaced apart from one another, the stitches 64 are substantially parallel to one another and are positioned in a second generally vertical direction. The underlying second panel 38 further has another plurality of rows of layer securement stitches 66 spaced apart from one another which are substantially parallel to one another and are positioned in a third generally horizontal direction. The rows of stitches 64 and the rows of stitches 66 are preferably positioned substantially perpendicular to one another, as seen in FIGS. 3. Rows of stitches 64, 66 of second panel 38 each extend substantially across second panel 38. As a result, in this embodiment the plurality of the rows of stitches 64, 66 of second panel 38 form a pattern of box stitches.

These plurality of rows of woven sheet securement stitches 62, 68 and 64, 66 are all composed of a high tensile strength fiber such as an aramid or such other suitable material. Preferably, Twaron® or Kevlar® are selectively employed as the stitching material to hold together ballistic resistant sheets 58, 60, FIG. 5A–5C. The plurality of rows of sheet securement stitches extend entirely through each of the woven sheets of ballistic resistant material which results in the forming of the individual sub-panels. The woven sheet securement stitches 62 and 68 are completely disposed through each of the ballistic resistant sheets of fabric 60, FIGS. 5A–5C, to form and establish top sub-panel 36. In similar fashion, the underlying sub-panel 38 is formed by the box stitching pattern of sheet securement stitches 64 and 66 which only connect the ballistic resistant fabric sheets 58, FIG. 5A–5C, together. The woven sheet securement stitches 62, 68 for panel 36 and the woven sheet securement stitches 64, 66 for panel 38 preferably only connect the layered sheets of a woven ballistic resistant material for their respective panels in order to define the distinct sub-panels 36, 38. Individual sub-panels may alternatively be formed by other suitable securement approaches such as stitching about the periphery of ballistic resistant layers, bar tacs, non-invasive securement of the layers and the like.

As a result, first panel 36 preferably contains a pattern of quilt stitches 62, 68 positioned substantially across panel 36 and second panel 38 contains a pattern of box stitches 64, 66 positioned substantially across panel 38. As discussed in more detail in U.S. Pat. No. 5,479,659 and incorporated herein, this embodiment of stitching patterns in the different panels 36, 38 that are adjacent and overlie one another provide transference of energy at time of impact by a bullet. As a result, the depth of penetration of the bullet is reduced and a reduction of bunching of garment 10 after an impact from the bullet is experienced. Advantageously, this helps to alleviate a second bullet which strikes garment 10, in proximity to the first bullet strike, from penetrating garment and striking the wearer's body.

To reduce potential binding of the layered sheets of panels 36, 38 upon receipt of ballistic impact, additional stitching extending entirely through and securing both of the sub-panels 36, 38 in the soft body armor panel 34 together has been added and forms part of the present invention. This improvement provides the wearer further assurance of performance of garment 10 upon multiple ballistic impact forces striking regions of the garments by preventing bunching, balling and shifting of the flexible sheets.

As seen in FIG. 3, the ballistic resistant garment 10 of the present invention includes a plurality of radial multi-panel securement stitches 70, 72, 74 which extend entirely through the ballistic resistant panels 36, 38 securing them together and providing the resistance to bunching, balling and shifting upon impact by a ballistic force and particularly maintaining the ballistic resistant panels 36, 38 in position to receive a second or multiple shot event.

Additionally, as also seen in FIG. 3, a plurality of vertical rows of stitches 76 are also disposed and secured entirely through the ballistic resistant panels 36, 38. The stitching rows 76 extend in a substantially vertical direction between a top edge 78 and bottom edge 80 of the ballistic resistant panels 36, 38.

The four vertical rows of stitches 76 are positioned in the central part of the overlying co-extensive ballistic resistant panels 36, 38 between the right edge and the left edge of the panels.

As seen in FIG. 3, a plurality of groups of radial stitching rows are shown with the rows of stitches being aligned in parallel. The woven body armor panel 34 includes overlying sub-panel 36 having an arrangement of quilt stitching and the underlying sub-panel 38 having box stitching. Stitches 64 run in generally a vertical direction with the rows of stitches 64 preferably spaced approximately 1¼ inches apart. Similarly, stitches 66 which run in generally a horizontal direction with rows of stitches 66 spaced approximately 1¼ inches apart. Rows of stitches 62 are preferably spaced approximately 1¼ inches apart and similarly, stitches 68 are preferably spaced approximately 1¼ inches apart forming the quilt pattern.

As seen in FIG. 3, soft body armor panel 34 has a multiplicity of stitches disposed in rows 70, 72, 74 through the sub-panels 36, 38 connecting the two sub-panels together. The rows 70, 72, 74 of radial stitches are positioned in a direction angularly displaced from the vertical direction of stitches 76 in which the vertical direction is determined generally between top 78 and bottom ends 80 of the soft body armor panel of the garment. More particularly, as seen in FIG. 3, a group formed of two rows of adjacently aligned parallel stitches 70 extends from an edge at the lower left portion 82 of panels 36, 38 to an opposing edge at the upper right portion 84 of the panels. The group 70 of rows of parallel stitches extend diagonally across the central region of panels 36, 38 over a sternum area of the wearer with the panels being positioned over the front of the torso. A second group of rows of parallel stitches 72, FIG. 3, extend from an edge of a lower right portion 86 of the ballistic resistant panels 36, 38 diagonally over the central region of the panels, and across the opposing edge of the upper left 88 portion of the panels.

The embodiment of FIG. 3 also illustrates a third group of rows of parallel stitches 74 which extend horizontally from the left edge 90 to the right edge 92 across the panels 36, 38 over the sternum area of the wearer upon the garment being worn over the front torso of the user. The groups of rows of horizontally spaced stitches 70, 72, 74 of FIG. 3, each extend entirely though all the layers of ballistic resistant material for each overlying panel 36, 38 in the garment. Preferably, each group has at least two rows of parallel stitches extending across the panels. As seen in FIG. 3, each group 70, 72, 74 shown has a pair of parallel spaced rows of stitches, however more than two rows for each group may suitably be employed. The rows of stitches 70, 72, 74 described herein are preferably constructed of high tensile strength aramid fibers such as Twaron® or Kevlar®.

Referring now to FIG. 4, an illustration of an exploded view of a single layer of composite body armor material 55 of the present invention is shown. The material is constructed with preferably four sub-layer resin plies 56A, 56B, 56C and 56D which includes a matrix of aqueous thermoplastic and has high tensile strength fibers disposed into each of the plies that extend in the directions illustrated by the lines 57A, 57B, 57C and 57D of each respective ply. As can be seen, each successive ply has its high tensile strength fibers extending in a transverse direction to one another. In fact, the high tensile strength fibers disposed within a first sub-layer ply of resin 56A, for example, is positioned in a first direction as illustrated by line 57A while the high tensile strength fibers disposed in a second sub-layer ply of resin 56B adjacent the first sub-layer ply are positioned in a direction illustrated by line 57B substantially normal to the fibers in the first sub-layer ply 56A. The preferred construction has four sub-layer plies 56A, 56B, 56C and 56D in which the high tensile strength fibers are disposed into each of the sub-layer plies 56A, 56B, 56C, and 56D. The fibers are positioned, as illustrated by lines 57A, 57B, 57C and 57D in a relative orientation of 0, 90, 0, 90 degrees in each successive sub-layer ply. Layers of GoldFlex® material sold by Allied Signal, Inc. of Petersburg, Va. may be suitably employed as a composite body armor material to form the composite panel.

The high tensile strength fibers utilized in sub-layer plies 56A, 56B, 56C and 56D are preferably aramid. Twaron™ T-2000 generally being 1500 denier, 1.5 dpf, manufactured by AKZO NOBEL, Inc. is preferably employed as a fiber impregnated in the resin matrix of the sub-layers of composite material. Alternatively, Kevlar® 129 of 1500 denier manufactured by E. I. Du Pont de Nemours & Co., of Wilmington, Del. may be suitably employed as well as other such fibers with comparable high tensile strength.

With sub-layer resin plies 56A, 56B, 56C and 56D positioned to overlie one another, and with each ply having the high tensile strength fibers oriented in the respective directions 57A, 57B, 57C and 57D, they are cross plied in a 0, 90, 0 and 90 degrees orientation relative to one another. The successive sub-layer plies 56A, 56B, 56C and 56D, are readily fused together through lamination and form a composite body armor layer 55. Sub-layer resin plies 56A, 56B, 56C, and 56D are secured together by a laminate covering which is constructed of two sheets 94, 96 of thermoplastic polyethylene film. Sheets 94, 96 enclose and sandwich together sub-layer plies 56A, 56B, 56C and 56D forming a single layer 55 of composite body armor material.

Now referring to FIGS. 5A–C, these views are enlarged illustrative depictions of an end view along line 5—5 in FIG. 2, of three embodiments of multi-component body armor panels 30A, 30B and 30C without stitches being shown. Each of these three versions of multi-component panels 30A, 30B and 30C represent three different threat levels of preventing projectile penetration under NIJ Standard 0101.03. Multi-component body armor panel 30A prevents a projectile penetration at Threat Level IIA; multi-component body armor panel 30B prevents a projectile penetration at Threat Level II and multi-component body armor panel 30C prevents projectile penetration at Threat Level IIIA.

As to multi-component body armor pad 30A, FIG. 5A, underlying woven body armor panel 34 is constructed of a first woven sub-panel 36 and second woven sub-panel 38. As discussed earlier first sub-panel 36 contains six sheets 60 of woven flexible aramid preferably utilizing 860 denier Twaron™ T-2000 or other suitable high tensile strength fibers such as 840 denier Kevlar® 129 , a product of E. I. Du Pont de Nemours and Company, of Wilmington, Del. Likewise, second sub-panel 38 contains six sheets 58 of woven flexible aramid fibers. Sheets 60, 58 as discussed earlier are maintained in separate sub-panels 36 and 38, respectively by employment of the sheet securement cross stitching 62, 64, 66, 68. The thinness of each sheet 60 and 58 is 0.0090 inches which when multiplied by twelve sheets comes to 0.1080 inches. The composite panel 32A, preferably has six layers in which each layer has a thinness of approximately 0.010 inches thereby making the total thinness of composite panel 32A approximately 0.060 inches. As a result, the overall thinness of multi-component body armor pad 30A is no greater than about 0.17 inches. At the same time, the areal weight of multi-component body armor pad 30A is no greater than and only about 0.69 lbs/ft$^2$. Regardless, of the thin and lightweight properties, the multi-component body armor pad 30A provides NIJ Certified ballistic resistance protection in preventing projectile penetration meeting NIJ Standard 0101.03 for Threat Level IIA certification tests.

As to multi-component body armor pad 30B, FIG. 5B, underlying woven body armor panel 34 is constructed of a first woven sub-panel 36 and second woven sub-panel 38. As discussed earlier first sub-panel 36 contains six overlying sheets 60 of woven flexible aramid preferably utilizing 860 denier Twaron™ T-2000 or other suitable high tensile strength fibers such as 840 denier Kevlar® 129, a product of E. I. Du Pont de Nemours and Company, of Wilmington, Del. As was discussed for multi-component body armor pad 30A, likewise, second sub-panel 38 contains six sheets 58 of woven flexible aramid fibers. Sheets 60, 58 as discussed earlier are maintained in separate sub-panels 36 and 38, respectively by employment of the stitching 62, 64, 66, 68 securing the woven sheets into the distinct sub-panels. The thinness of each sheet 60 and 58 is approximately 0.0090 inches which when multiplied by twelve sheets, as set forth above, comes to 0.108 inches. The composite panel 32B, has nine layers GoldFlex® type of composite ballistic resistant material with each composite layer having a thinness of 0.010 inches thereby establishing total thinness of composite panel 32B being approximately 0.090 inches. As a result, the overall thinness of multi-component body armor pad 30B is no greater than about 0.20 inches. The areal weight of multi-component body armor pad 30B is no greater than about 0.84 lbs/ft$^2$. Even with the advantages of these thin and lightweight properties, this multi-component body armor pad 30B still provides NIJ Certified ballistic resistance protection in preventing projectile penetration of the multi-component body armor pad 30B in accordance with NIJ Standard 0101.03 for Threat Level II.

Similarly, with regard to multi-component body armor pad 30C, FIG. 5C, underlying woven body armor panel 34 is constructed of a first woven sub-panel 36 and second woven sub-panel 38. As discussed earlier first sub-panel 36 preferably contains six overlying sheets 60 of woven flexible aramid preferably utilizing 860 denier Twaron™ T-2000 or other suitable high tensile strength fibers such as 840 denier Kevlar® 129 , a product of E. I. Du Pont de Nemours and Company, of Wilmington, Del. As was discussed for multi-component body armor pads 30A and 30B, second sub-panel 38 preferably contains six sheets 58 of woven flexible aramid Twaron® T-2000 fibers. Sheets 60, 58 as discussed earlier are maintained in separate sub-panels 36 and 38, respectively by employment of the sheet securement stitching 62, 64, 66, 68, FIG. 3. The thinness of each sheet 60 and 58, FIG. 5C, is approximately 0.0090 inches which when multiplied by twelve sheets, as set forth above, comes to 0.108 inches. The composite panel 32C, has twelve layers of the aramid and resin composite material with each layer 55 having a thinness of 0.010 inches resulting in the total thinness of composite panel 32B being approximately 0.12 inches. As a result, the overall thinness of multi-component body armor pad 30C is no greater than about 0.23 inches. The areal weight of multi-component body armor pad 30C for Threat Level IIIA is shown to be no greater than about 0.99 lbs/ft$^2$. The thin and lightweight properties of this multi-component body armor pad 30C of FIG. 5C provides NIJ Certified ballistic resistance protection in preventing projectile penetration of the multi-component body armor pad 30C in accordance with NIJ Standard 0101.03 for Threat Level IIIA certification tests.

While a detailed description of the preferred embodiments of invention has been given, it should be appreciated that many variations can be made thereto without departing from the scope of the invention as set forth in the appended claims.

I claim:

1. A ballistic resistant protective garment of multi-component construction for covering and protecting vital portions of a human body of a wearer having a front strike face portion for positioning away from the wearer, comprising:

a plurality of layers of composite body armor material in which each layer has a plurality of sub-layer resin plies in which each ply has a high tensile strength fiber extending and disposed therein, in which the high tensile strength fiber of one ply extends transverse to the high tensile strength fiber of an adjacent ply and a laminate covering to enclose and sandwich together the sub-layer plies of resin and high tensile strength fiber to form a single layer of the plurality of layers of composite body armor material;

a plurality of flexible woven sheets constructed of a second high tensile strength fiber positioned to overlie one another; and means for securing the plurality of layers of composite body armor material to the plurality of flexible woven sheets such that the layers of composite body armor material are positioned at the strike face of the protective garment.

2. The ballistic resistant protective garment of claim 1 in which the high tensile strength fibers extending and disposed in the sub-layer resin plies is an aramid.

3. The ballistic resistant protective garment of claim 2 in which the high tensile strength fibers are generally 1500 denier.

4. The ballistic resistant protective garment of claim 1 in which the sub-layer resin plies are constructed of an aqueous thermoplastic.

5. The ballistic resistant protective garment of claim 1 in which the laminate covering includes thermoplastic polyethylene film.

6. The ballistic resistant protective garment of claim 1 includes greater than two sub-layer plies.

7. The ballistic resistant protective garment of claim 6, includes four sub-layer plies.

8. The ballistic resistant protective garment of claim 1 in which the high tensile strength fibers disposed within a first sub-layer ply of resin is positioned in a first direction and the high tensile strength fibers disposed in a second sub-layer ply of resin adjacent the first sub-layer ply are positioned in a direction substantially normal to the high tensile strength fibers in the first sub-layer ply.

9. The ballistic resistant protective garment of claim 8, including four sub-layer plies in which the high tensile strength fibers are positioned in a relative orientation of 0, 90, 0, 90 degrees in each successive sub-layer ply.

10. The ballistic resistant protective garment of claim 1 including a carrier sleeve for encasing the layers and the sheets.

11. The ballistic resistant protective garment of claim 12 in which said carrier sleeve is constructed of woven cloth.

12. The ballistic resistant protective garment of claim 1 including multi-component body armor pad formed of the plurality of layers of composite material and the flexible woven sheets in which the plurality of layers includes no more than six layers the composite body armor material overlying no more than twelve flexible woven sheets having a combined areal weight which is not greater than about 0.69 lbs./ft$^2$ and having a combined thickness no greater than about 0.17 inches.

13. The ballistic resistant protective garment of claim 1 including a multi-component body armor pad formed of the plurality of layers of composite material and the flexible woven sheets in which the plurality of layers includes no more than nine layers of the composite body armor material overlying no more than twelve flexible woven sheets having a combined areal weight which is not greater than about 0.84 lbs./ft$^2$ and having a combined thickness no greater than about 0.20 inches.

14. The ballistic resistant protective garment of claim 1 including a multi-component body armor pad formed of the plurality of layers of composite material and the flexible woven sheets, in which the plurality of layers includes no more than twelve layers of the composite body armor material overlying no more than twelve flexible woven sheets having a combined areal weight in which the combined areal weight is not greater than about 0.99 lbs./ft$^2$ and having a combined thickness no greater than about 0.23 inches.

15. The ballistic resistant protective garment of claim 1 including means for forming the plurality of flexible woven sheets into a first and a second panel in which each of the first and second panels includes at least two sheets.

16. The ballistic resistant protective garment of claim 15, in which said means to form the first and second panels includes a plurality of stitches disposed into a first panel only connecting the at least two sheets within the first panel in which the plurality of stitches are positioned in a row in a first direction and another plurality of stitches are disposed into a second panel only connecting the at least two sheets within the second panel, in which the other plurality of stitches are positioned in at least two rows with the at least two rows placed in a second and third direction respectively, in which the second and third directions are transverse to one another and in which the row in the first direction of the first panel is transverse to the two rows in the second and third directions of the second panel.

17. The ballistic resistant protective garment of claim 18 in which the second high tensile strength fiber is an aramid.

18. The ballistic resistant protective garment of claim 19 in which the aramid is woven into an imbalanced weave of 24 by 22.

19. The ballistic resistant protective garment of claim 16, in which the plurality of stitches disposed in the first panel includes a plurality of rows of stitches spaced apart and substantially parallel to one another in the first direction and includes a plurality of another rows of stitches spaced apart from one another and substantially parallel to one another in which the plurality of row and said plurality of other rows are transverse to one another, and in which the other plurality of stitches disposed in the second panel includes a plurality of rows of stitches spaced apart from one another and substantially parallel to one another positioned in the second direction and the other plurality of rows of stitches spaced apart from one another and substantially parallel to one another positioned in the third direction.

20. The ballistic resistant protective garment of claim 19, in which the rows and the other rows in the first panel are substantially perpendicular.

21. The ballistic resistant protective garment of claim 20 in which the plurality and the other plurality of rows of stitches of the first panel each extend substantially across the first panel and in which the plurality of and the other plurality of rows of stitches of the second panel each extend substantially across the second panel.

22. The ballistic resistant protective garment of claim 21, in which the plurality of and the other plurality of rows of stitches of the first panel form a pattern of quilt stitches in the first panel and in which the second panel form a pattern of box stitches.

23. The ballistic resistant protective garment of claim 15, in which each of the first and second panels include six flexible woven sheets each.

24. The ballistic resistant protective garment of claim 15, includes a multiplicity of stitches disposed in a row through the two panels connecting the two panels together in which the row is positioned in a direction angularly displaced from a substantially vertical direction determined generally between top and bottom ends of the protective garment.

25. The ballistic resistant protective garment of claim 24, in which the multiplicity of stitches includes:

a group of a plurality of at least two rows of parallel stitches which extend from an edge of a lower left portion of the panels and extend diagonally across the panel over a sternum area of the wearer, with the panels positioned over the front of a torso, to an opposing edge of an upper right portion of the panels;

a second group of another plurality of at least two rows of parallel stitches which extend from an edge of a lower right portion of the panels and extend diagonally across the panels over the sternum area of the wearer; and a third group of at least two rows of stitches which extend horizontally from a left edge of the panels across the panels and over the sternum area of the wearer to an opposing edge on the right edge of the panels.

26. The ballistic resistant protective garment of claim 1 in which the securing means includes at least one bar tac which penetrates through the plurality of layers of composite body armor material and the plurality of flexible woven sheets.

27. The ballistic resistant protective garment of claim 26, in which the at least one bar tac is positioned proximate to an edge of the plurality of layers of composite body armor material and the plurality of flexible woven sheets.

28. The ballistic resistant protective garment of claim 27, in which the at least one bar tac is located in an upper right corner, lower right corner, upper left and lower left corners of the plurality of layers of composite body armor material.

29. The ballistic resistant protective garment of claim 28, includes a bar tac positioned between the upper right corner and the lower right corner of the plurality of layers of composite body armor material and another bar tac between the upper left corner and lower left corner of the plurality of layers of composite body armor material.

30. A ballistic resistant protective garment of multi-component construction for covering and protecting vital portions of a human body of a wearer, comprising:

a composite panel constructed of ballistic resistant;

a plurality of flexible woven sheets constructed of high tensile strength fibers; and means for securing the composite panel to the plurality of flexible woven sheets forming a multi-component body armor pad such that the layers of the composite panel are positioned at a strike face of the multi-component body armor pad which has an areal weight not greater than about 0.69 lbs/ft$^2$ in which the multi-component body armor pad is capable of preventing projectile penetration of the multi-component body armor pad with a ballistic round fired at the strike face according to NIJ Standard 0101.03 for Threat Level IIA.

31. A ballistic resistant protective garment of multi-component construction for covering and protecting vital portions of a human body of a wearer, comprising:

a composite panel constructed of ballistic resistant layers;

a plurality of flexible woven sheets constructed of high tensile strength fibers; and means for securing the composite panel to the plurality of flexible woven sheets forming a multi-component body armor pad such that the layers of the composite panel are positioned at a strike face of the multi-component body armor pad which has a thinness of not greater than 0.17 inches in which the multi-component body armor pad is capable of preventing projectile penetration of the multi-component body armor pad with a ballistic round fired at the strike face according to NIJ Standard 0101.03 for Threat Level IIA.

32. A ballistic resistant protective garment of multi-component construction for covering and protecting vital portions of a human body of a wearer, comprising:

a composite panel constructed of ballistic resistant layers;

a plurality of flexible woven sheets constructed of high tensile strength fibers; and means for securing the composite panel to the plurality of flexible woven sheets forming a multi-component body armor pad such that the layers of the composite panel are positioned at a strike face of the multi-component body armor pad which has an areal weight not greater than about 0.84 lbs/ft$^2$ in which the multi-component body armor pad is capable of preventing projectile penetration of the multi-component body armor pad with a ballistic round fired at the strike face according to NIJ Standard 0101.03 for Threat Level II.

33. A ballistic resistant protective garment of multi-component construction for covering and protecting vital portions of a human body of a wearer, comprising:

a composite panel constructed of ballistic resistant layers;

a plurality of flexible woven sheets constructed of high tensile strength fibers; and means for securing the composite panel to the plurality of flexible woven sheets forming a multi-component body armor pad such that the layers of the composite panel are positioned at a strike face of the multi-component body armor pad which has a thinness of not greater than 0.20 inches in which multi-component the body armor pad is capable of preventing projectile penetration of the multi-component body armor pad with a ballistic round fired at the strike face according to NIJ Standard 0101.03 for Threat Level II.

34. A ballistic resistant protective garment of multi-component construction for covering and protecting vital portions of a human body of a wearer, comprising:

a composite panel constructed of ballistic resistant layers;

a plurality of flexible woven sheets constructed of high tensile strength fibers; and means for securing the composite panel to the plurality of flexible woven sheets forming a multi-component body armor pad such that the layers of the composite panel are positioned at a strike face of the multi-component body armor pad which has an areal weight not greater than about 0.99 lbs/ft$^2$ in which the multi-component body armor pad is capable of preventing projectile penetration of the multi-component body armor pad with a ballistic round fired at the strike face according to NIJ Standard 0101.03 for Threat Level IIIA.

35. A ballistic resistant protective garment of multi-component construction for covering and protecting vital portions of a human body of a wearer, comprising:

a composite panel constructed of ballistic resistant layers;

a plurality of flexible woven sheets constructed of high tensile strength fibers; and means for securing the composite panel to the plurality of flexible woven sheets forming a multi-component body armor pad such that the layers of the composite panel are positioned at a strike face of the multi-component body armor pad which has a thinness of not greater than 0.23 inches in which the multi-component body armor pad is capable of preventing projectile penetration of the multi-component body armor pad with a ballistic round fired at the strike face according to NIJ Standard 0101.03 for Threat Level IIIA.

36. A ballistic resistant protective garment of multi-component construction for covering and protecting vital portions of a body of a wearer having a front strike face portion for positioning away from the wearer, comprising:

a plurality of layers of composite body armor material in which each layer has a plurality of sub-layer resin plies in which each ply has a high tensile strength fiber extending and disposed therein, in which the high tensile strength fiber of one ply extends transverse to the high tensile strength fiber of an adjacent ply and a laminate covering to enclose and sandwich together the sub-layer plies of resin and high tensile strength fiber to form a single layer of the plurality of layers of composite body armor material; and a plurality of flexible woven sheets constructed of a second high tensile strength fiber positioned to overlie one another in which the layers of composite body armor material are positioned at the strike face of the protective garment and overlie the plurality of flexible woven sheets positioned nearer the body of the wearer.

37. The ballistic resistant protective garment of claim 36, including means for securing the plurality of layers of composite body armor material to the plurality of flexible woven sheets.

38. The ballistic resistant protective garment of claim 37, in which the securing means includes at least one bar tac which penetrates through the plurality of layers of composite body armor material and the plurality of flexible woven sheets.

39. The ballistic resistant protective garment of claim 38, in which the at least one bar tac is positioned proximate to an edge of the plurality of layers of composite body armor material and the plurality of flexible woven sheets.

40. The ballistic resistant protective garment of claim 39, in which the at least one bar tac is located in an upper right corner, lower right corner, upper left and lower left corners of the plurality of layers of composite body armor material.

41. The ballistic resistant protective garment of claim 40, includes a bar tac positioned between the upper right corner and the lower right corner of the plurality of layers of composite body armor material and another bar tac between the upper left corner and lower left corner of the plurality of layers of composite body armor material.

42. The ballistic resistant protective garment of claim 36, in which the high tensile strength fibers extending and disposed in the sub-layer resin plies is an aramid.

43. The ballistic resistant protective garment of claim 42, in which the high tensile strength fibers are generally 1500 denier.

44. The ballistic resistant protective garment of claim 36, in which the sub-layer resin plies are constructed of an aqueous thermoplastic.

45. The ballistic resistant protective garment of claim 36, in which the laminate covering includes thermoplastic polyethylene film.

46. The ballistic resistant protective garment of claim 36, includes greater than two sub-layer plies.

47. The ballistic resistant protective garment of claim 46, includes four sub-layer plies.

48. The ballistic resistant protective garment of claim 36, in which the high tensile strength fibers disposed within a first sub-layer ply of resin is positioned in a first direction and the high tensile strength fibers disposed in a second sub-layer ply of resin adjacent the first sub-layer ply are positioned in a direction substantially normal to the high tensile strength fibers in the first sub-layer ply.

49. The ballistic resistant protective garment of claim 43, including four sub-layer plies in which the high tensile strength fibers are positioned in a relative orientation of 0, 90, 0, 90 degrees in each successive sub-layer ply.

50. The ballistic resistant protective garment of claim 36, including a carrier sleeve for encasing the layers and the sheets.

51. The ballistic resistant protective garment of claim 50, in which said carrier sleeve is constructed of woven cloth.

52. The ballistic resistant protective garment of claim 36, including a multi-component body armor pad formed of the plurality of layers of composite material and the flexible woven sheets in which the plurality of layers includes no more than six layers of the composite body armor material overlying no more than twelve flexible woven sheets having a combined areal weight which is not greater than about 0.69 lbs./ft$^2$ and having a combined thickness no greater than about 0.17 inches.

53. The ballistic resistant protective garment of claim 36, including a multi-component body armor pad formed of the plurality of layers of composite material and the flexible woven sheets in which the plurality of layers includes no more than nine layers of the composite body armor material overlying no more than twelve flexible woven sheets having a combined areal weight which is not greater than about 0.84 lbs./ft$^2$ and having a combined thickness no greater than about 0.20 inches.

54. The ballistic resistant protective garment of claim 36, including a multi-component body armor pad formed of the plurality of layers of composite material and the flexible woven sheets, in which the plurality of layers includes no more than twelve layers of the composite body armor material overlying no more than twelve flexible woven sheets having a combined areal weight in which the combined areal weight is not greater than about 0.99 lbs./ft$^2$ and having a combined thickness no greater than about 0.23 inches.

55. The ballistic resistant protective garment of claim 36, including means for forming the plurality of flexible woven sheets into a first and a second panel in which each of the first and second panels includes at least two sheets.

56. The ballistic resistant protective garment of claim 55, in which said means to form the first and second panels includes a plurality of stitches disposed into a first panel only connecting the at least two sheets within the first panel in which the plurality of stitches are positioned in a row in a first direction and another plurality of stitches are disposed into a second panel only connecting the at least two sheets within the second panel, in which the other plurality of stitches are positioned in at least two rows with the at least two rows placed in a second and third direction respectively, in which the second and third directions are transverse to one another and in which the row in the first direction of the first panel is transverse to the two rows in the second and third directions of the second panel.

57. The ballistic resistant protective garment of claim 56, in which the second high tensile strength fiber is an aramid.

58. The ballistic resistant protective garment of claim 57, in which the aramid is woven into an imbalanced weave of 24 by 22.

59. The ballistic resistant protective garment of claim 56, in which the plurality of stitches disposed in the first panel includes a plurality of rows of stitches spaced apart and substantially parallel to one another in the first direction and includes a plurality of another rows of stitches spaced apart from one another and substantially parallel to one another in which the plurality of row and said plurality of other rows are transverse to one another, and in which the other plurality of stitches disposed in the second panel includes a plurality of rows of stitches spaced apart from one another and substantially parallel to one another positioned in the second direction and the other plurality of rows of stitches spaced apart from one another and substantially parallel to one another positioned in the third direction.

60. The ballistic resistant protective garment of claim 59, in which the rows and the other rows in the first panel are substantially perpendicular.

61. The ballistic resistant protective garment of claim 60, in which the plurality and the other plurality of rows of stitches of the first panel each extend substantially across the first panel and in which the plurality of and the other plurality of rows of stitches of the second panel each extend substantially across the second panel.

62. The ballistic resistant protective garment of claim 61, in which the plurality of and the other plurality of rows of stitches of the first panel form a pattern of quilt stitches in the first panel and in which the plurality of rows and other plurality of rows of stitches of the second panel form a pattern of box stitches in the second panel.

63. The ballistic resistant protective garment of claim 55, in which each of the first and second panels include six flexible woven sheets each.

64. The ballistic resistant protective garment of claim 55, includes a multiplicity of stitches disposed in a row through the two panels connecting the two panels together in which the row is positioned in a direction angularly displaced from a substantially vertical direction determined generally between top and bottom ends of the protective garment.

65. The ballistic resistant protective garment of claim 64, in which the multiplicity of stitches includes:

a group of a plurality of at least two rows of parallel stitches which extend from an edge of a lower left portion of the panels and extend diagonally across the panel over a sternum area of the wearer, with the panels positioned over the front of a torso, to an opposing edge of an upper right portion of the panels;

a second group of another plurality of at least two rows of parallel stitches which extend from an edge of a lower right portion of the panels and extend diagonally across the panels over the sternum area of the wearer; and a third group of at least two rows of stitches which extend horizontally from a left edge of the panels across the panels and over the sternum area of the wearer to an opposing edge on the right edge of the panels.

* * * * *